US011564536B2

(12) United States Patent
Meagher et al.

(10) Patent No.: US 11,564,536 B2
(45) Date of Patent: Jan. 31, 2023

(54) BATH KIT

(71) Applicant: VBC Tracy LLC, Philadelphia, PA (US)

(72) Inventors: Patrick Louis Meagher, Denton, TX (US); Darrin Griechen, Spokane, WA (US); Robert Stanford, Flowery Branch, GA (US)

(73) Assignee: VBC TRACY LLC, Philadelphia, PA (US)

( * ) Notice: Subject to any disclaimer, the term of this patent is extended or adjusted under 35 U.S.C. 154(b) by 591 days.

(21) Appl. No.: 16/682,093

(22) Filed: Nov. 13, 2019

(65) Prior Publication Data

US 2020/0146511 A1 May 14, 2020

Related U.S. Application Data

(60) Provisional application No. 62/760,516, filed on Nov. 13, 2018.

(51) Int. Cl.

| | |
|---|---|
| ***A47K 3/08*** | (2006.01) |
| ***A47K 3/28*** | (2006.01) |
| ***B65B 5/08*** | (2006.01) |
| ***E04F 13/072*** | (2006.01) |
| ***B65D 85/64*** | (2006.01) |
| ***B65D 6/02*** | (2006.01) |
| *A47K 3/32* | (2006.01) |

(52) U.S. Cl.

CPC ..... *A47K 3/08* (2013.01); *A47K 3/284* (2013.01); *B65B 5/08* (2013.01); *B65D 9/06* (2013.01); *B65D 85/64* (2013.01); *E04F 13/072* (2013.01); *A47K 3/32* (2013.01)

(58) Field of Classification Search

CPC . A47K 3/08; A47K 3/284; A47K 3/32; B65B 5/08; E04F 13/072

USPC ..... 52/35

See application file for complete search history.

(56) References Cited

U.S. PATENT DOCUMENTS

| | | | | | |
|---|---|---|---|---|---|
| 5,414 | A | * | 1/1848 | Woods | A47K 3/32 4/600 |
| 991,222 | A | * | 5/1911 | Miller | A47K 3/32 4/603 |
| 1,077,199 | A | * | 10/1913 | James | A47C 17/00 297/188.1 |
| 1,879,782 | A | * | 9/1932 | Barce | A47K 3/284 4/612 |
| 2,010,864 | A | * | 8/1935 | Jones | A47K 3/284 4/612 |

(Continued)

FOREIGN PATENT DOCUMENTS

WO WO-2020087118 A1 * 5/2020

*Primary Examiner* — Benjamin R Shaw

(74) *Attorney, Agent, or Firm* — Volpe Koenig

(57) ABSTRACT

A bath kit configured to transition from a crate form to a bathroom form is provided. The bath kit includes a bathtub enclosure surrounded by a first sidewall sub-assembly, a second sidewall sub-assembly, a rear bracing sub-assembly, a drop ceiling sub-assembly, and a floor sub-assembly. The sub-assembly components form the three sides, a top, and a bottom of the bath kit in crate form. These components are also configured to form the walls, ceiling, and floor of the bathtub enclosure in the bathroom form. The method of assembling the bath kit and the method of transforming the bath kit from a crate form to a bathroom form are also provided.

8 Claims, 5 Drawing Sheets

(56) References Cited

U.S. PATENT DOCUMENTS 2,282,329 A * 5/1942 Johnson ..... A47K 3/284 52/459
2,282,362 A * 5/1942 Johnson ..... A47K 3/284 52/27
2,508,970 A * 5/1950 Richardson ..... A47K 3/32 4/552
3,182,767 A * 5/1965 Kuehl ..... A47K 3/284 52/592.1
3,996,705 A * 12/1976 Gutierrez ..... E04F 13/18 16/225
4,008,804 A * 2/1977 Poggiali ..... B65D 5/5054 206/583
4,152,789 A * 5/1979 Heath ..... A47K 3/284 4/614
4,423,528 A * 1/1984 Wiedmeier ..... A47K 3/284 4/613
4,553,276 A * 11/1985 Paradis ..... B29C 65/5014 4/596
4,993,201 A * 2/1991 Bunyard ..... A47K 3/284 4/596
5,079,880 A * 1/1992 Reid ..... A47K 3/008 52/312
5,619,826 A * 4/1997 Wu ..... E04H 1/1216 52/79.5
7,979,926 B1 * 7/2011 Boegler ..... A47K 3/32 4/603
10,624,313 B1 * 4/2020 Gray ..... A47K 3/32
10,993,584 B1 * 5/2021 Highland ..... A47K 3/08
2006/0230516 A1 * 10/2006 Wilson ..... A47K 3/30 4/538
2008/0127406 A1 * 6/2008 Hammond ..... A47K 3/16 4/538
2008/0141453 A1 * 6/2008 Lin ..... A47K 3/284 4/596
2012/0036794 A1 * 2/2012 Dabrowski ..... A47K 3/16 29/446
2012/0124915 A1 * 5/2012 Wilson ..... A47K 3/30 52/35
2013/0061388 A1 * 3/2013 Lebrun ..... A47K 3/284 4/613
2013/0205685 A1 * 8/2013 Leatherman ..... E04H 1/1266 52/79.1
2013/0264240 A1 * 10/2013 Wallis ..... B65D 85/00 206/459.5
2015/0107018 A1 * 4/2015 Vagedes ..... A47K 3/161 4/584
2016/0206156 A1 * 7/2016 Smith ..... A47K 3/40
2019/0038083 A1 * 2/2019 Liu ..... A47K 3/284
2021/0032874 A1 * 2/2021 Zimbric ..... A47K 3/284
2021/0219789 A1 * 7/2021 Cook ..... E03C 1/0408
2022/0031125 A1 * 2/2022 Ferris ..... A47K 3/008

* cited by examiner

BATH KIT

CROSS REFERENCE TO RELATED APPLICATION

This application claims the benefit of U.S. Provisional Application No. 62/760,516 for BATH KIT filed on Nov. 13, 2018, which is incorporated by reference as if fully set forth.

FIELD OF INVENTION

The present invention relates generally to the art of bathroom construction, and more specifically to packaging, shipping, and installing bathroom components, and a method of assembly thereof.

BACKGROUND

Bathroom components, such as tub and shower inserts, toilets, cabinets, closets, vanities, shelving, etc., are big and bulky. Typically each component is shipped separately, requiring multiple packages. Moreover, because these components tend to be heavy and fragile, adequate package protection is required. Yet, damage during shipping is still common. Often, the material/products used to ship and protect the packages are thrown away after delivery. Thus, shipping these bathroom components to their onsite location tends to be costly and wasteful.

SUMMARY

A bath kit configured to transition from a crate form to a bathroom form is provided. The bath kit includes a bathtub enclosure surrounded by a sub-assembly. The sub-assembly includes a first sidewall sub-assembly, a second sidewall sub-assembly, a rear bracing sub-assembly, a drop ceiling sub-assembly, and a floor sub-assembly. The sub-assembly components form three sides, a top, and a bottom of the bath kit in crate form. These components are also configured to form the walls, ceiling, and floor of the bathtub enclosure in the bathroom form.

The bath kit in crate form may also include a plurality of crate components disposed in the bathtub enclosure, and a drywall section that forms the fourth side of the bath kit in crate form. The plurality of crate components may include at least one of a vanity, a sink, a linen closet, a toilet, and finishing goods.

Once the bath kit is shipped and placed at its onsite location, the bath kit components in crate form transition to form a bathroom. Therefore, packaging, shipping, and installing the bath kit is quick, efficient, and resourceful. The method of assembling the bath kit and the method of transforming the bath kit from a crate form to a bathroom form are also provided.

BRIEF DESCRIPTION OF THE DRAWINGS

The foregoing summary, as well as the following detailed description will be better understood when read in conjunction with the appended drawings. For the purpose of illustration, there is shown in the drawings different embodiments. It should be understood, however, that the teachings are not limited to the precise bath kit arrangement shown.

DETAILED DESCRIPTION

A bath kit 100 that transitions from a crate form to a bathroom form is provided. The bath kit 100 includes bathroom components that form a crate for transportation purposes. After the bath kit 100 arrives at its onsite location, the components are unpackaged and disassembled, if need be, and installed in the bathroom. Therefore, packaging, shipping, and installing the bath kit is quick, efficient, and less wasteful than conventional bathroom component shipments and installations. The method of assembling the bath kit and the method of transforming the bath kit from a crate form to a bathroom form are also provided.

Figure 1:
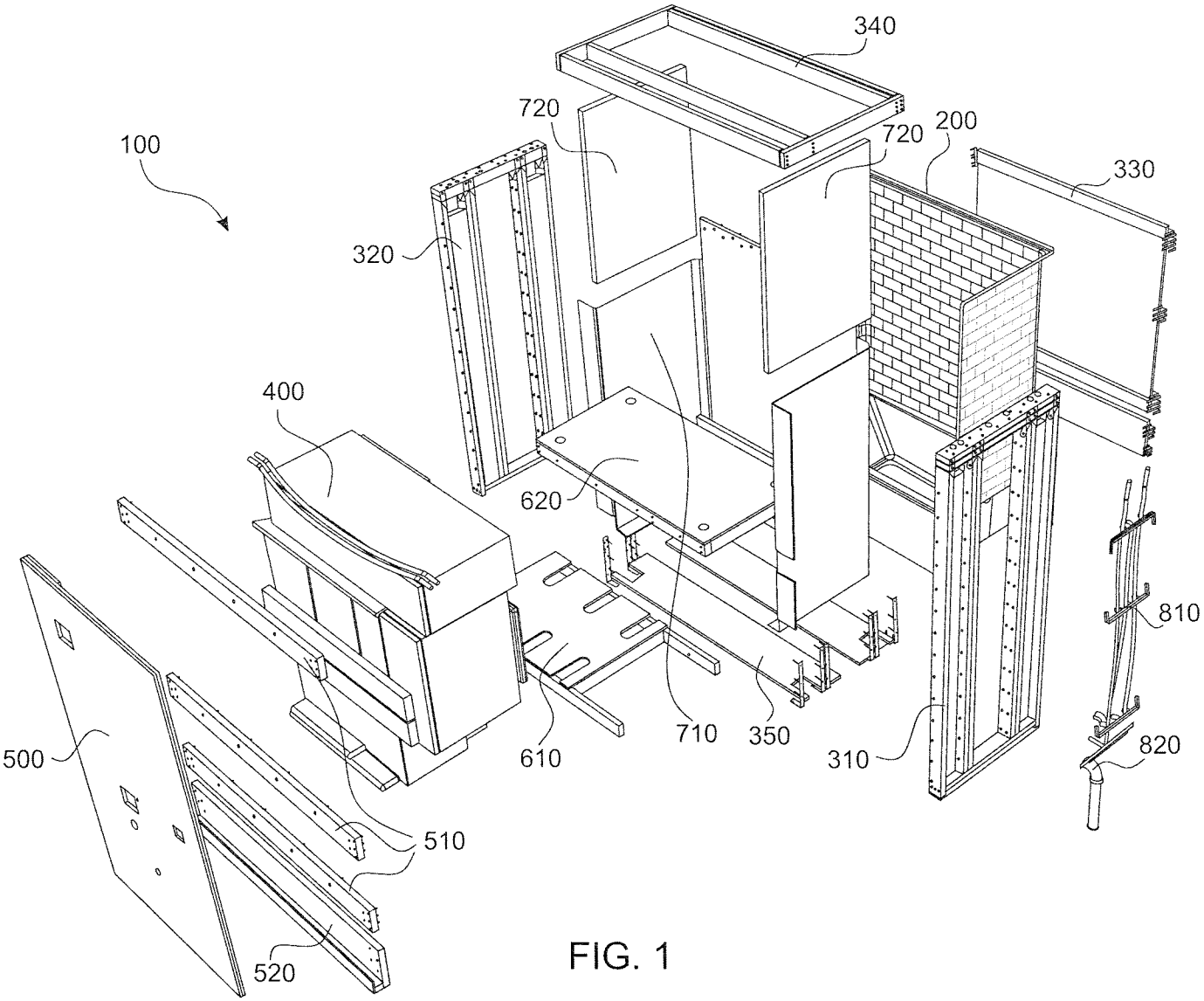
FIG. 1 is an exploded view of a bath kit in crate form.

FIG. 1 is an exploded view of a bath kit 100 in crate form. The bath kit 100 includes a bathtub enclosure 200, a first sidewall sub-assembly 310, a second sidewall sub-assembly 320, a rear bracing sub-assembly 330, a drop ceiling sub-assembly 340, and a floor sub-assembly 350. The first sidewall sub-assembly 310, the second sidewall sub-assembly 320, the rear bracing sub-assembly 330, the drop ceiling sub-assembly 340, and the floor sub-assembly 350 may be made from wood, steel, or any sufficiently rigid material. As described in more detail herein, the first sidewall sub-assembly 310, the second sidewall sub-assembly 320, the rear bracing sub-assembly 330, the drop ceiling sub-assembly 340, and the floor sub-assembly 350 form three sides, the top, and the bottom of the bath kit 100 in crate form.

The bath kit 100 may also include a plurality of crate contents 400. The plurality of crate contents 400 may include a vanity 400*a*, a sink 400*b*, a linen closet (not shown), a toilet 400*c*, and finishing goods 400*d* (for example towel racks, mirrors, hardware, lights, etc.). The plurality of crate contents 400 may include only some of these bathroom components or may include additional bathroom components not listed. The plurality of crate contents 400 may be loaded within the bathtub enclosure 200 in the bath kit 100 in crate form. By packing the plurality of crate contents 400 within the bathtub enclosure 200, the plurality of crate contents 400 are protected by the bathtub enclosure 200, the first sidewall sub-assembly 310, the second sidewall sub-assembly 320, the rear bracing sub-assembly 330, the drop ceiling sub-assembly 340 and the floor sub-assembly 350. The plurality of crate contents 400 are protected during shipping and handling of the bath kit 100 in crate form. Loading the plurality of crate contents 400 within the bathtub enclosure 200 is also space efficient.

The bath kit 100 may also include at least one drywall section 500. Although FIG. 1 shows one drywall section 500, additional drywall sections 500 may be included. The bath kit 100 may also include a plurality of cross braces 510 and a drywall carrier 520. The cross braces 510 and the drywall carrier 520 may be connected to the first sidewall sub-assembly 310, the second sidewall sub-assembly 320, the drop ceiling sub-assembly 340 and/or the floor sub-assembly 350. The plurality of cross braces 510 provides structure and stability to the bath kit 100 in crate form. The plurality of cross braces 510 and/or the drywall section 500 enclose and protect components loaded within the bathtub enclosure 200 such as the plurality of crate contents 400. Moreover, the drywall carrier 520 is designed to hold or support the drywall section 500. Together, the drywall section 500, cross braces, 510 and drywall carrier 520 make up the fourth and final side of the bath kit 100 in crate form. Alternatively, the cross braces 510 and/or drywall carrier 520 may be excluded and the drywall section 500 acts as the fourth and final side of the bath kit 100 in crate form. If the cross braces 510 and/or drywall carrier 520 are excluded, the drywall section 500 may be secured to the first sidewall sub-assembly 310, the second sidewall sub-assembly 320, the drop ceiling sub-assembly 340 and/or the floor sub-assembly 350. This fourth side encloses the plurality of crate contents 400 and the bathtub enclosure 200.

The bath kit 100 may also include a lower shelf 610 and an upper shelf 620 when the bath kit 100 is in crate form. The lower shelf 610 and the upper shelf 620 hold and/or support the plurality of loaded crate contents 400. Moreover, the lower shelf 610 and upper shelf 620 may be temporarily connected to one or more components of the sub-assembly 310, 320, 330, 340 when the bath kit 100 is in crate form. For example, the lower shelf 610 and upper shelf 620 may be connected to the drop ceiling sub-assembly 340. This connection takes the load from the plurality of crate contents 400 off the bathtub enclosure 200 when the bath kit 100 is in crate form. Taking the load off the bathtub enclosure 200 helps protect the bathtub enclosure 200 from damage during shipping and handling.

The bath kit 100 in crate form may also include a corrugated tub protector 710 and/or foam inserts 720. These components protect the bathtub enclosure 200 and plurality of crate contents 400 during shipping and handling.

The bath kit 100 may also include a shower tree sub-assembly 810 and an overflow sub-assembly 820. The shower tree sub-assembly 810 and the overflow sub-assembly 820 are secured to a sidewall sub-assembly 310, 320 when the bath kit 100 is in crate form.

Figure 2:
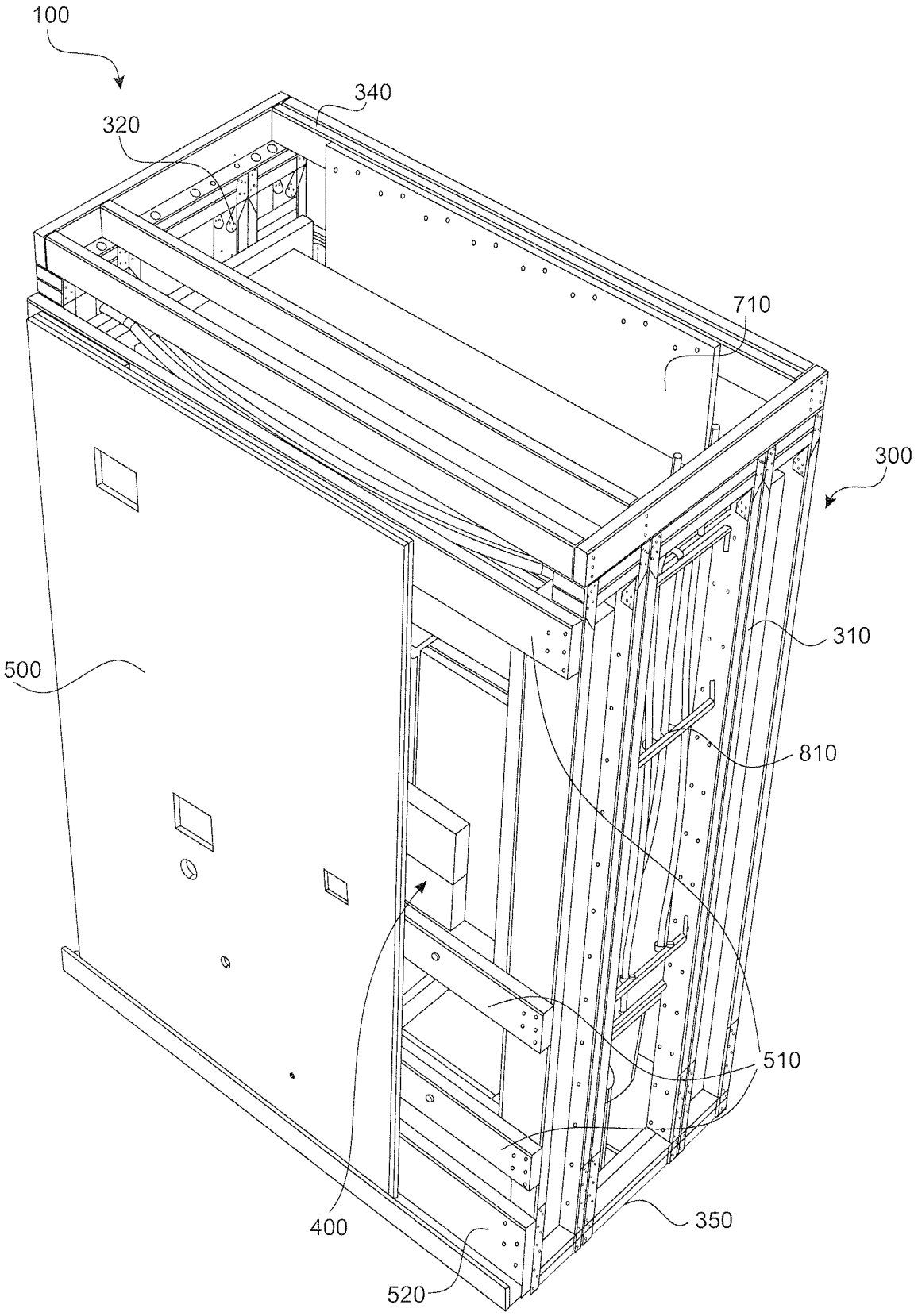
FIG. 2 is a front, top, right perspective view of the bath kit in crate form.

FIG. 2 is a front, top, right perspective view of the bath kit 100 in crate form. In FIG. 2, the bath kit 100 is assembled in crate form. The first sidewall sub-assembly 310, second sidewall sub-assembly 320, rear bracing sub-assembly 330 (not visible in FIG. 2), drop ceiling sub-assembly 340, and floor sub-assembly 350 connect to form a sub-assembly 300. The sub-assembly 300 may be connected via connectors such as nails, screws, or bolts. The first sidewall sub-assembly 310 forms a first side of the bath kit 100 in the crate form. The second sidewall sub-assembly 320 forms a second side of the bath kit 100 in the crate form. The rear bracing sub-assembly 330 forms a third or rear side of the bath kit 100 in the crate form (not visible in FIG. 2). The drop ceiling sub-assembly 340 forms the top of the bath kit 100 in the crate form. The corrugated tub protector 710 may be connected to the drop ceiling sub-assembly 340 to keep the corrugated tub protector 710 in place and the bathtub enclosure 200 protected during shipping. The floor sub-assembly 350 forms the bottom of the bath kit 100 in the crate form. The design of the floor sub-assembly 350 may include recesses or a space. The recesses or space allow construction equipment, such as a forklift, to pick up and move the bath kit 100 in crate form.

The drywall section 500 may form the fourth side of the bath kit 100 in crate form. The bath kit 100 may also include the plurality of cross braces 510 and the drywall carrier 520 as the fourth wall of the bath kit 100 in crate form. The bath kit 100 assembled in crate form creates a space efficient, well protected crate to transport many essential bathroom components to the job site. The crate reduces cost and waste by using bathroom components to form the crate in which they are shipped. The bath kit 100 in crate form may be wrapped and/or sealed to protect the bath kit 100 components from damage during shipping and handling.

Figure 3:
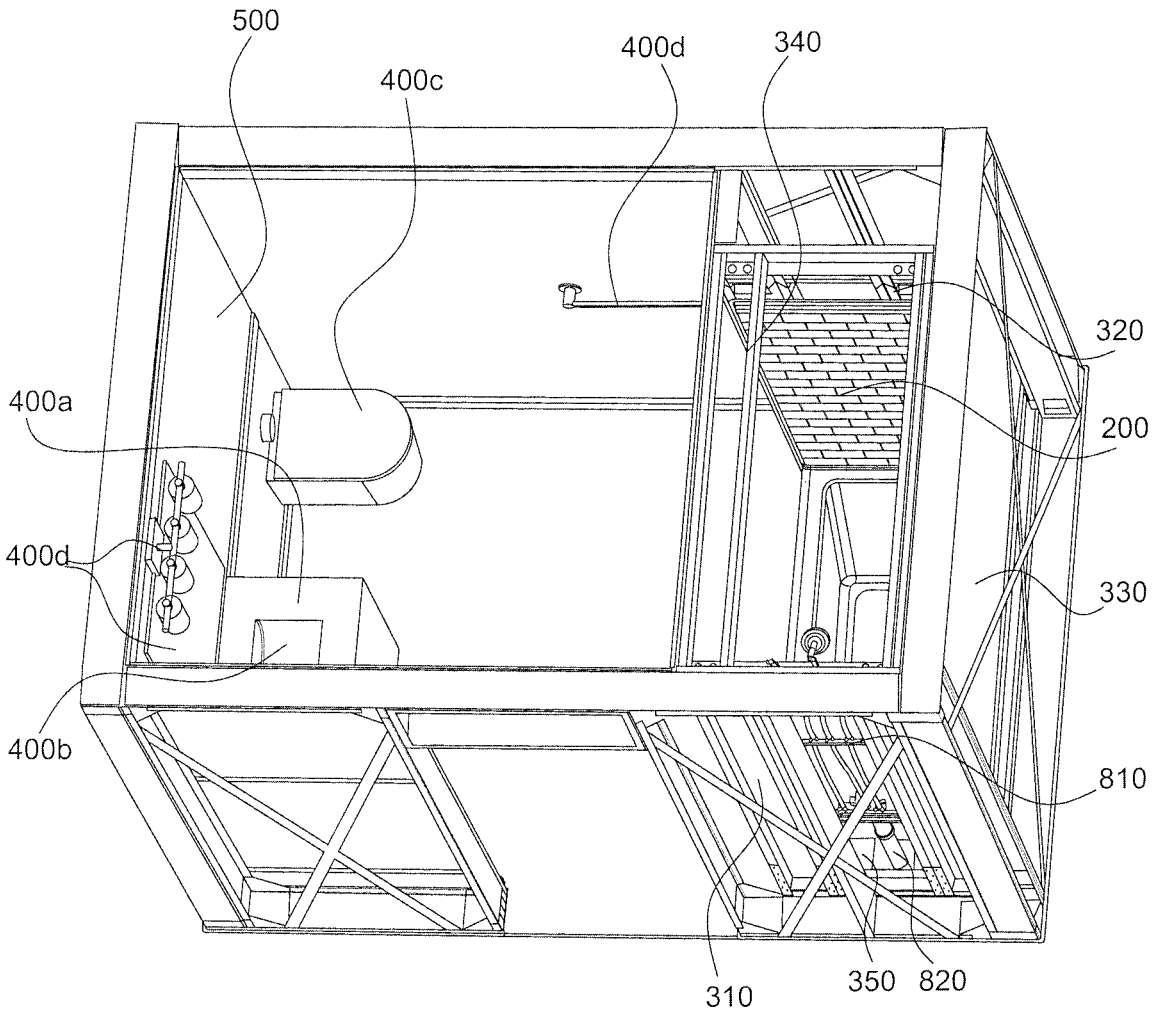
FIG. 3 is a front, top, right perspective view of the bath kit in bathroom form.

FIG. 3 is a front, top, right perspective view of the bath kit 100 in bathroom form. As shown in FIG. 3, the first sidewall sub-assembly 310 is configured to become a first sidewall of the bathtub enclosure 200 when the bath kit 100 is in bathroom form. The second sidewall sub-assembly 320 is configured to become a second sidewall of the bathtub enclosure 200 when the bath kit 100 is in bathroom form. The rear bracing sub-assembly 330 is configured to become a rear brace of the bathtub enclosure 200 when the bath kit 100 is in bathroom form. The drop ceiling sub-assembly 340 is configured to become the ceiling of the bathtub enclosure 200 when the bath kit 100 is in bathroom form. The floor sub-assembly 350 is configured to become the floor under the bathtub enclosure 200 when the bath kit 100 is in bathroom form. The floor sub-assembly 350 may be designed to create a gap or space between the bathtub enclosure 200 and the subflooring, gypsum concrete, and/or flooring when the bath kit 100 is in bathroom form. This gap or space allows for inspection of the bathtub enclosure 200 after installation. Because the first sidewall sub-assembly 310, the second sidewall sub-assembly 320, the rear bracing sub-assembly 330, the drop ceiling sub-assembly 340, and the floor sub-assembly 350 encase the bathtub enclosure 200 and are connected in crate form, the bathtub enclosure 200, the first sidewall sub-assembly 310, the second sidewall sub-assembly 320, the rear bracing sub-assembly 330, the drop ceiling sub-assembly 340, and the floor sub-assembly 350 may be moved to its installation location and installed as one unit. Thus, the bathtub enclosure 200, the first sidewall sub-assembly 310, the second sidewall sub-assembly 320, the rear bracing sub-assembly 330, the drop ceiling sub-assembly 340, and the floor sub-assembly 350 do not have to be installed component by component on the job site, thereby saving time and money.

When the bath kit 100 is in bathroom form, the plurality of crate contents 400 is unloaded and installed in the bathroom. For example, a vanity 400*a*, sink 400*b*, toilet 400*c*, and finishing goods 400*d* are installed in the bathroom at their designated locations. The drywall section 500 is also configured to become the drywall behind the vanity 400*a* and/or sink 400*b* when the bath kit 100 is in bathroom form. The shower tree sub-assembly 810 and the overflow sub-assembly 820 remain connected to the first or second sidewall sub-assembly 310, 320 and provide plumbing to the bathtub enclosure 200 when the bath kit 100 is in bathroom form.

Figure 4:
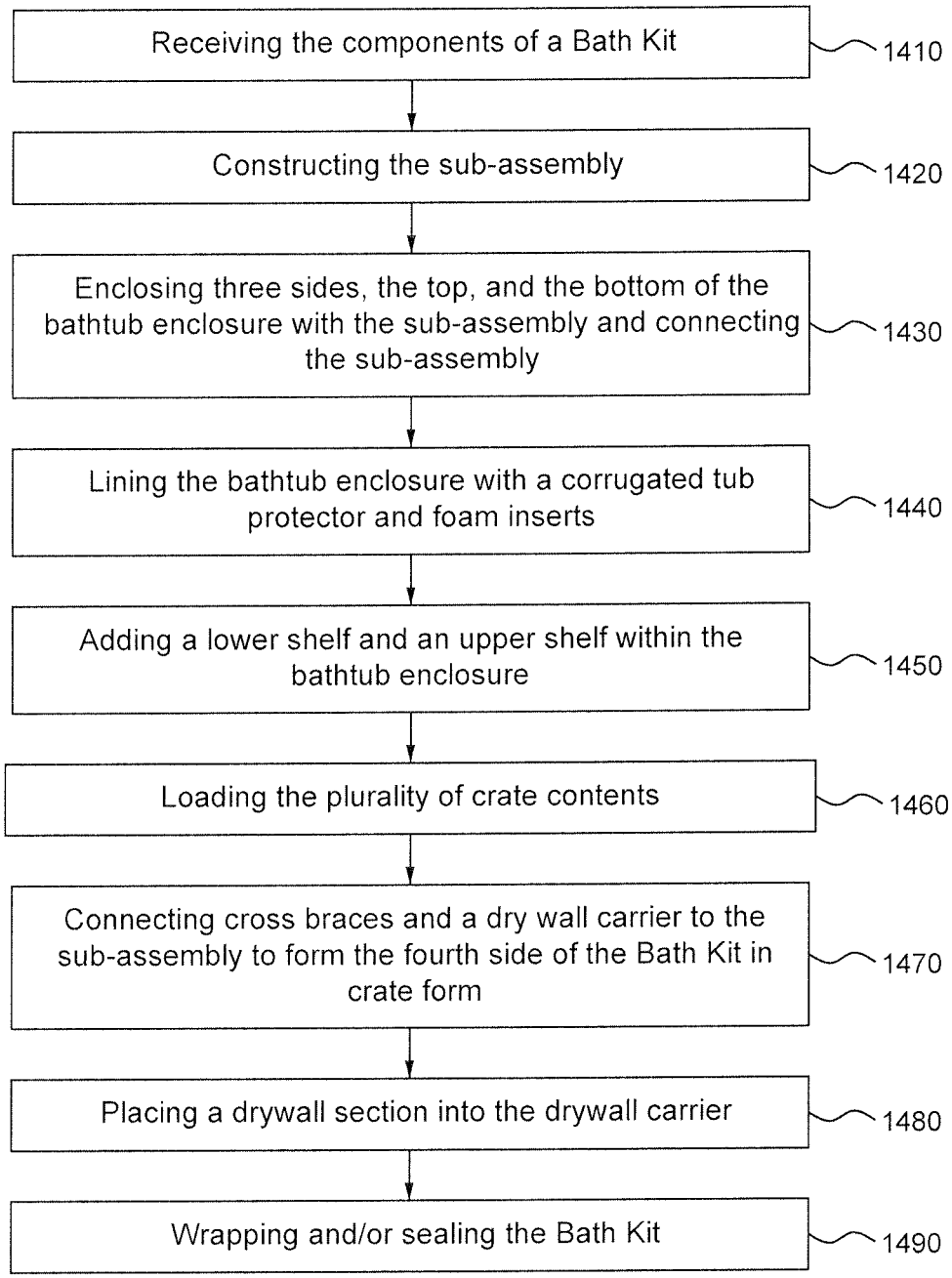
FIG. 4 is a flow chart of a method of assembling the bath kit in crate form.

FIG. 4 is a flow chart of a method of assembling the bath kit in crate form 1400. First 1410, the method 1400 includes receiving the components of the bath kit 100. The bath kit 100 includes all the components, details, and descriptions described herein. Second 1420, the sub-assembly 300 is constructed. Third 1430, the sub-assembly 300 components, including the first sidewall sub-assembly 310, the second sidewall sub-assembly 320, the rear bracing sub-assembly 330, the drop ceiling sub-assembly 340, and the floor sub-assembly 350, enclose three sides, the top, and the bottom of the bathtub enclosure 200 and are connected.

The method 1400 may include the step 1440 of adding a corrugated tub protector 710 and foam inserts 720 to protect the bathtub enclosure 200 and the plurality of crate contents 400 during shipping and handling. The method 1400 may include the step 1450 of adding a lower shelf 610 and an upper shelf 620 to support the plurality of crate contents 400. The lower shelf 610 and/or upper shelf 620 may be connected to the sub-assembly 300. The method 1400 may also include the step 1460 of loading the plurality of crate contents 400 within the bathtub enclosure 200. The plurality of crate contents 400 may be loaded onto the lower shelf 610 and upper shelf 620.

The method 1400 may include the step 1470 of connecting the plurality of cross braces 510 and/or the drywall carrier 520 to the sub-assembly 300 to form the fourth wall of the bath kit 100 in crate form. Alternatively, the drywall section 500 may be connected to the sub-assembly 300 to form the fourth wall of the bath kit 100 in crate form. If the method 1400 includes the step 1470 of connecting the plurality of cross braces 510 and/or the drywall carrier 520 to the sub-assembly 300 to form the fourth wall of the bath kit 100 in crate form, the method 1400 may also include the step 1480 of adding the drywall section 500 to the bath kit 100 in crate form by setting the drywall section 500 into the drywall carrier 520. The method 1400 may also include the step 1490 of sealing or wrapping the bath kit 100 in crate form. This method 1400 provides a bath kit 100 in crate form, which is ready to be shipped.

Figure 5:
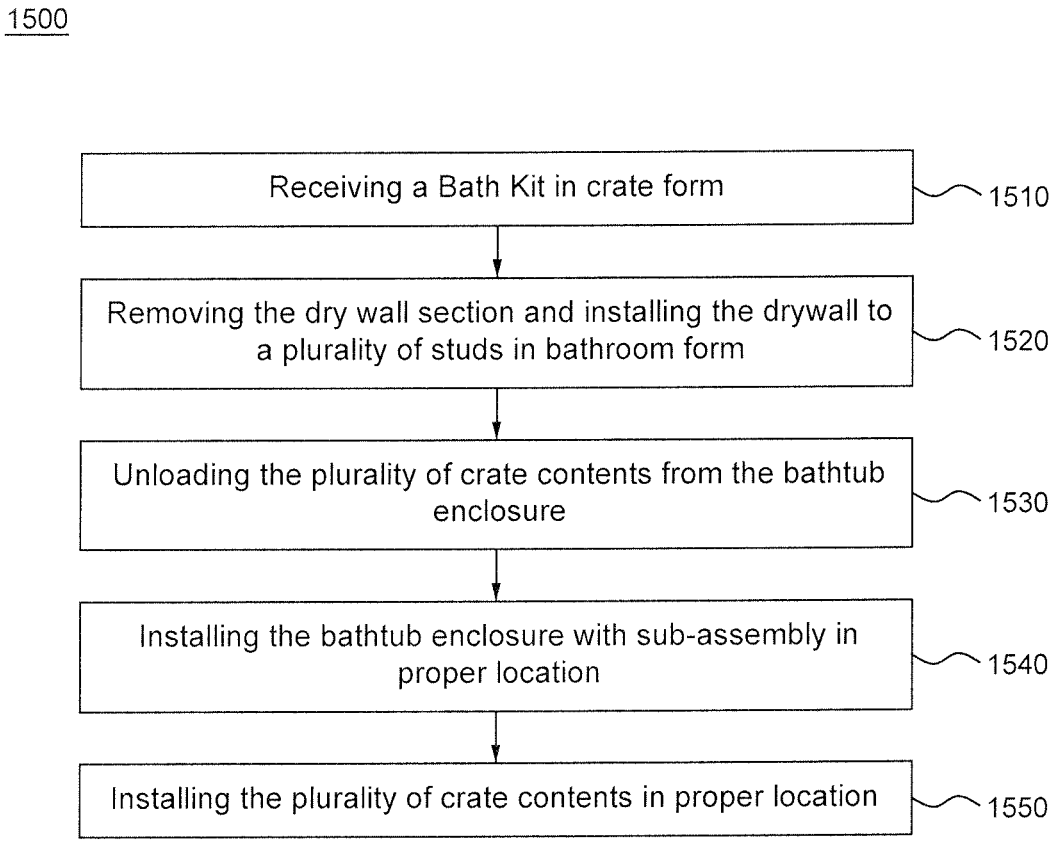
FIG. 5 is a flow chart of a method of transforming the bath kit from the crate form to the bathroom form.

FIG. 5 is a flow chart of a method of transforming the bath kit from the crate form to the bathroom form 1500. First 1510, a bath kit 100 in crate form is received. Second 1520, the drywall section 500 forming the fourth side of the bath kit 100 in crate form is removed and installed to a plurality of studs in the bathroom form. Third 1530, the plurality of crate contents 400 are unloaded from the bathtub enclosure 200. Fourth 1540, the bathtub enclosure 200 and surrounding sub-assembly 300, which formed the first side, the second side, the third side, the top, and the bottom of the bath kit 100 in crate form, are installed at the proper location in the bathroom form. The method 1500 may also include the step 1550 of installing the plurality of crate contents 400 in the proper location in the bathroom form.

Having thus described in detail a preferred selection of embodiments of the present bath kit, it is to be appreciated and will be apparent to those skilled in the art that many physical changes could be made to the bath kit without altering the inventive concepts and principles embodied therein. The present embodiments are therefore to be considered in all respects as illustrative and not restrictive, the scope being indicated by the appended claims rather than by the foregoing description, and all changes which come within the meaning and range of equivalency of the claims are therefore to be embraced therein.

What is claimed is:

1. A bath kit configured to transition from a crate form to a bathroom form, the bath kit comprising:

a bathtub enclosure within a sub-assembly, the sub-assembly including a first sidewall sub-assembly, a second sidewall sub-assembly, a rear bracing sub-assembly, a drop ceiling sub-assembly, and a floor sub-assembly;

the first sidewall sub-assembly forming a first side of the bath kit in the crate form and configured to become a first sidewall of the bathtub enclosure in the bathroom form;

the second sidewall sub-assembly forming a second side of the bath kit in the crate form and configured to become a second sidewall of the bathtub enclosure in the bathroom form;

the rear bracing sub-assembly forming a third side of the bath kit in the crate form and configured to become a rear bracing of the bathtub enclosure in the bathroom form;

the drop ceiling sub-assembly forming a top of the bath kit in the crate form and configured to become a ceiling of the bathtub enclosure in the bathroom form; and the floor sub-assembly forming a bottom of the bath kit in the crate form and configured to become a floor under the bathtub enclosure in the bathroom form.

2. The bath kit of claim 1 further comprising a drywall section forming a fourth side of the bath kit in the crate form and configured to become a wall in bathroom form.

3. The bath kit of claim 1 further comprising a plurality of crate contents disposed in the bathtub enclosure.

4. The bath kit of claim 3 wherein the crate contents comprise at least one of a vanity, a sink, a linen closet, a toilet, and finishing goods.

5. The bath kit of claim 3 further comprising an upper shelf and a lower shelf disposed in the bathtub enclosure, the upper shelf and the lower shelf supporting the plurality of crate contents.

6. The bath kit of claim 1 further comprising a tub protector in crate form.

7. The bath kit of claim 1 wherein the floor sub-assembly creates a gap between the bathtub enclosure and a subflooring in the bathroom form.

8. The bath kit of claim 1 wherein the floor sub-assembly includes at least one recess.

* * * * *